United States Patent [19]

Jinkins

[11] 4,361,929

[45] Dec. 7, 1982

[54] VACUUM CLEANER TOOL HAVING A TWO-POSITION ROTARY BRUSH

[75] Inventor: Danny R. Jinkins, Bel Air, Md.

[73] Assignee: Black & Decker Inc., Newark, Del.

[21] Appl. No.: 247,827

[22] Filed: Mar. 26, 1981

[51] Int. Cl.[3] ..... A47L 5/34

[52] U.S. Cl. ..... 15/355; 15/392

[58] Field of Search ..... 15/383, 392, 355, 356, 15/370

[56] References Cited

U.S. PATENT DOCUMENTS

| | | | |
|---|---|---|---|
| 1,462,574 | 7/1923 | Hoover | 15/392 X |
| 2,176,769 | 10/1939 | Martinet | 15/392 X |
| 2,230,722 | 2/1941 | Lang et al. | 15/392 X |
| 2,607,069 | 8/1952 | Hahn . | |
| 2,612,483 | 9/1952 | Dearing . | |
| 2,707,792 | 5/1955 | Waller . | |
| 2,734,211 | 2/1956 | Vance . | |
| 2,785,431 | 3/1957 | Pardee . | |
| 3,005,224 | 10/1961 | Magarian . | |
| 3,225,374 | 12/1965 | Daley et al. . | |
| 3,639,941 | 2/1972 | Kirwan et al. . | |
| 3,959,847 | 1/1976 | Kaulig . | |
| 4,221,019 | 9/1980 | Jäger . | |

*Primary Examiner*—Chris K. Moore

*Attorney, Agent, or Firm*—Harold Weinstein; Edward D. Murphy; Walter Ottesen

[57] ABSTRACT

A vacuum cleaner tool is provided which comprises a housing and a motor positioned in the housing, the motor having a driving pulley connected to the output thereof. A rotary agitator brush is mounted in the housing and has a portion thereof extending from the housing for contacting a surface to be vacuumed. The brush has an axle which extends therefrom along the axis thereof. A drive belt couples the pulley to the brush and an end cap is mounted on the axle of the brush for mounting the brush in the housing in two positions. The brush extends a smaller distance from the housing in the first of the two positions. The center of the end cap is positioned with respect to the axis of the brush such that when the cap is rotated 180°, the brush is shifted between the two positions while the distance from the center of the pulley to the axis of the brush is maintained constant. Further, the brush has first, second, third and fourth axial bores which are aligned with the axis thereof, and the axle is positioned in the first axial bore and extends therefrom. A bearing is fixed to the periphery of the second axial bore for rotatably mounting the brush on the axle. The bearing includes a flange which extends radially from the one end thereof, with the flange being positioned in the third bore. The end cap is mounted on the portion of the axle which extends from the first bore.

5 Claims, 6 Drawing Figures

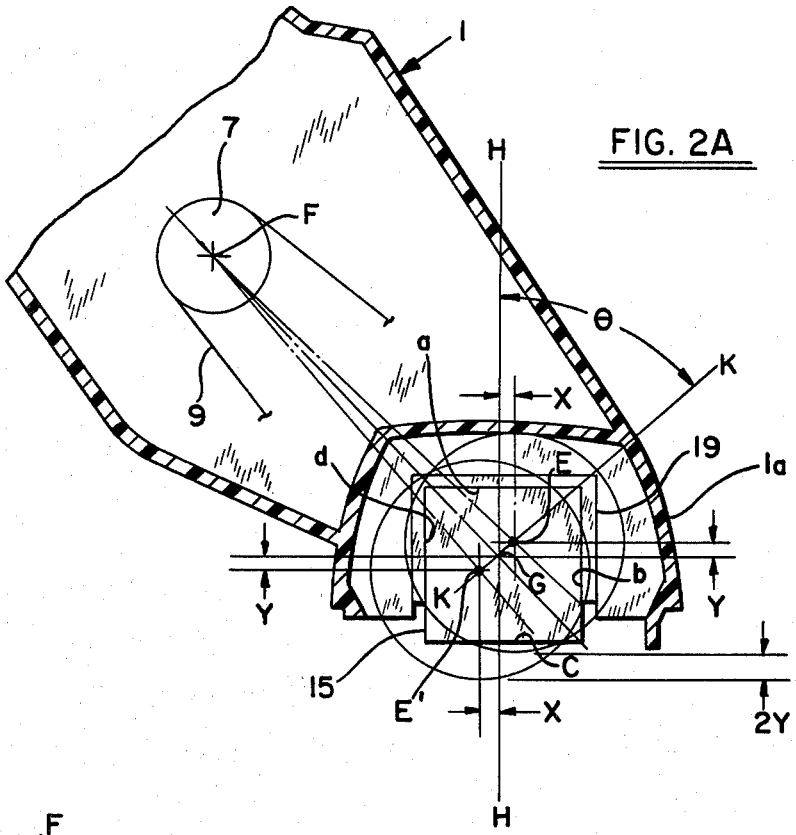
FIG. 2A
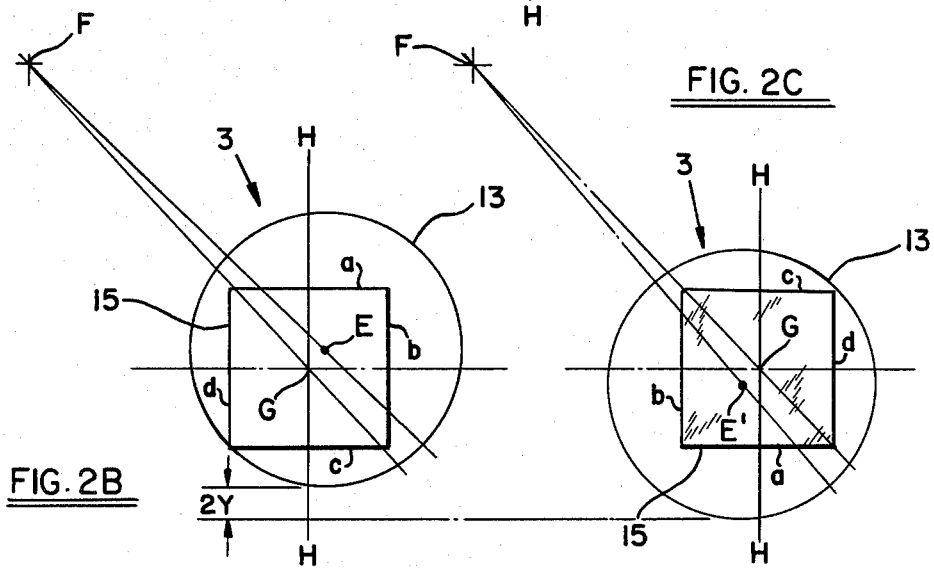
FIG. 2B
FIG. 2C

VACUUM CLEANER TOOL HAVING A TWO-POSITION ROTARY BRUSH

BACKGROUND OF THE INVENTION

1. Field of the Invention

The present invention is directed to an improved vacuum cleaner tool and, in particular, to a vacuum cleaner tool having a motor-driven, rotary agitator brush therein. The rotary brush may be mounted in the tool housing in either of two positions, with the brush extending from the housing by different amounts depending upon which of the two positions the brush is mounted, and the distance from the brush axis to the center of a pulley connected to the motor remains constant in either of the two positions of the brush. Further, a relatively small diameter bearing is used and a bearing structure is provided therefor.

2. Description of the Prior Art

It is conventional in vacuum cleaner tools to use rotary agitators such as a rotary brush which extends from the vacuum cleaner tool housing to contact and agitate a surface to be cleaned. Rotary brushes of this type are driven by either electric or vacuum-powered motors which are coupled to the rotary brush by means of a pulley on the motor shaft and a drive belt coupling the pulley to the rotary brush.

One of the problems in the prior art vacuum cleaner tools of this type is that, as a result of use, the bristles of the brush become worn and thus the distance which the brush extends from the housing is reduced. At some predetermined point, the bristles become too worn and the agitator brush is ineffective.

Prior art vacuum cleaners, such as that shown in U.S. Pat. No. 2,707,792, have means for varying the distance which the brush extends from the housing. In devices such as that shown in this patent, a cap on the end of the rotary brush has a hub which may be mounted in the housing in either of two positions to vary the distance which the rotary brush extends from the housing. However, in devices such as that shown in U.S. Pat. No. 2,707,792, when the brush is shifted from the first position to the second position by the rotation of the hub, the distance between the drive pulley and the rotary brush is changed, thereby changing the length of the drive belt. This results in a decrease in efficiency, since the drive belt is no longer tensioned for optimum performance.

Other prior art vacuum cleaner tools, such as those shown in U.S. Pat. Nos. 2,612,483; 3,005,224 and 3,639,941 have structure for varying the tension of a pulley belt which drives the rotary brush. However, in each of these patents, the structure for varying the tension is a camming device in which the axle of the rotary brush is positioned in an inclined slot so that it can move in the slot in order to maintain a constant belt tension. Conventional tools of this type do not have provisions for varying the distance which a brush extends from the housing by predetermined amounts.

Another problem often encountered in prior art vacuum cleaner tools is their efficiency in edge cleaning; that is, the efficiency of the tool in cleaning a portion of a surface which is located near the edge of the tool. In prior art tools, such as those shown in U.S. Pat. Nos. 2,607,069; 2,707,792; 2,734,211; 2,785,431; 3,225,374; 3,959,847 and 4,221,019, bristles on the periphery of the rotary brush are not positioned near the edges of the rotary brush or they are positioned close to the edge only because the brush has a relatively large diameter dowel, because the mounting structure which mounts the brush axle onto the housing requires that a large bore be drilled in the end of the brush, thus making it difficult to have a sufficient depth at the edges of the dowel of the rotary brush to implant the bristles.

SUMMARY OF THE INVENTION

It is the primary object of the present invention to provide a vacuum cleaner tool having a motor-driven rotary agitator brush therein wherein the distance which the brush extends from the housing can be varied without varying the tension of the drive belt which couples the rotary brush to a motor for driving it.

It is another object of the present invention to provide an end cap for a rotary brush of a vacuum cleaner tool wherein the axis of the rotary brush is eccentrically positioned with respect to the end cap such that when the end cap is rotated with respect to the tool housing, the position of the axis of the rotary brush is changed with respect to the housing.

It is another object of the present invention to provide a vacuum cleaner tool with a rotary brush having an end cap thereon, which is engaged by the housing of the tool. The axis of the rotary brush is displaced from the center of the end cap by orthagonal distances X and Y, wherein $X=Y \tan \theta$, where $\theta$ is the angle between the center line of the end cap and the line which passes through the center of the end cap and the point defined by distances X and Y.

It is still another object of the present invention to provide a structure for mounting a relatively small, rotary brush within the housing of a vacuum cleaner tool wherein the internal portion of the rotary brush which is occupied by the mounting structure is minimized, thereby permitting the insertion of bristles near the edge of the rotary brush, which results in enhancement of the cleaning in the area of the edge of the tool.

It is still a further object of the present invention to provide a bearing for supporting the rotary brush on an axle passing therethrough wherein the bearing has a flange at one end thereof for holding the bearing in a proper position in the rotary brush.

The present invention is directed to a vacuum cleaner tool which comprises a housing and a motor positioned in the housing, the motor having a driving pulley connected to the output thereof. A rotary agitator brush is mounted in the housing and has a portion thereof extending from the housing for contacting a surface to be vacuumed, and the brush has an axle which extends therefrom along the axis thereof. A drive belt couples the pulley to the brush and an end cap is mounted on the axle of the brush for mounting the brush in the housing in two positions.

The brush extends different distances from the housing in the two positions thereof. The center of the end cap is positioned with respect to the axis of the brush such that when the cap is rotated 180°, the brush is shifted between the two positions while the distance from the center of the pulley to the axis of the brush is maintained constant. Further, the brush has a first axial bore which extends along the axis thereof, and the axle is positioned in the first axial bore and extends therefrom. The brush has a second bore coaxial with the first bore which extends partially into the brush and a bearing is fixed to the periphery of the second bore, the bearing rotatably mounting the brush on the axle. The brush also includes a third bore coaxial with the first and second bores, with the third bore extending partially into the brush. The bearing includes a flange which extends radially from the end thereof, with the flange being positioned in the third bore for holding the bearing in position in the first bore. The brush also includes a fourth bore coaxial with the other three bores. If desired, a resilient washer, such as felt, may be placed in the fourth bore to seal the first, second and third bores. The end cap is mounted on the portion of the axle which extends from the first bore, and the end cap has a bearing surface which may contact the flange of the bearing.

BRIEF DESCRIPTION OF THE DRAWINGS

FIG. 2A is a sectional view of a portion of the tool of the present invention;

FIGS. 2B and 2C illustrate the two positions of the end cap of the tool of the present invention;

DETAILED DESCRIPTION OF THE PREFERRED EMBODIMENT

Figure 1:
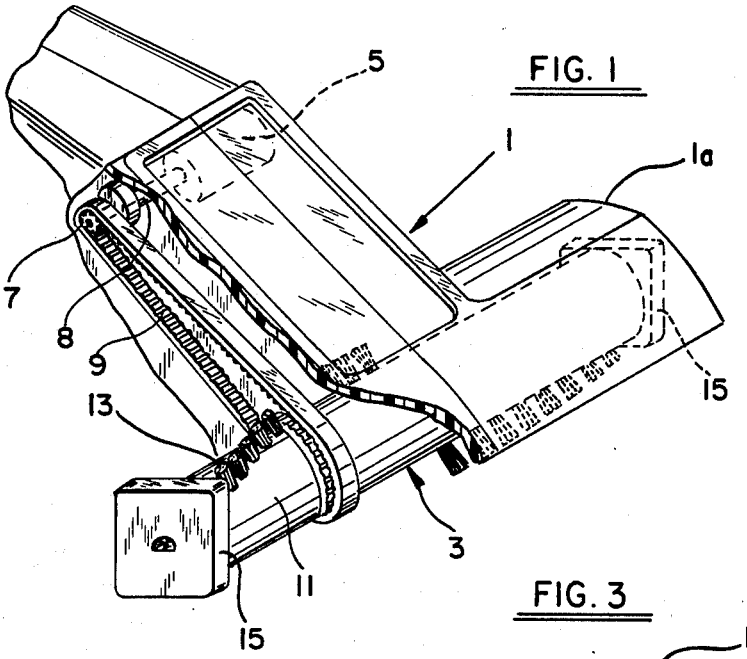
FIG. 1 is a partial cut-away perspective view of a tool of the present invention.
Figure 3:
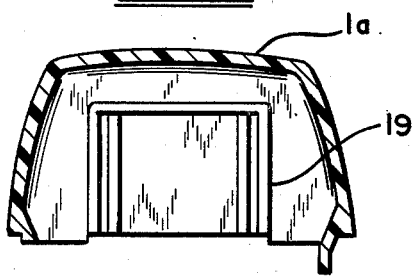
FIG. 3 is a sectional view of a portion of the tool of the present invention.

Referring to the drawings, a vacuum cleaner tool of the present invention comprises a housing 1 which houses therein a rotary agitator brush 3 which is driven by a motor 5, such as an air-powered turbine. The motor 5 has a pulley 7 coupled to the output shaft 8 thereof, and the pulley 7 is coupled to the rotary brush 3 through a drive belt 9. The rotary brush is mounted in the brush enclosure portion 1*a* of the housing 1.

The rotary brush 3 comprises a cylindrical member or dowell 11 which has a plurality of bristles 13 extending therefrom, the bristles being held in place by staples 14. End caps 15 are mounted on each end of the dowel 11. The end caps 15 are mounted in a U-shaped retaining member 19 which is formed on the end walls of the brush enclosing portion of the housing 1*a*. The shape of the end cap 15 is such that it may be inserted into the receiving member 19 in two positions, the second position being rotated 180° with respect to the first position.

The principle of one aspect of the present invention is that illustrated by reference to FIGS. 2A, 2B and 2C. When the end cap 15 is positioned in the receiving member 19 in the position shown in FIG. 2B, the sides a, b, c and d of the end cap 15 are oriented as indicated, and the axis of the rotary brush is located at point E. The center of the pulley 7 is located at point F, and the center of the end cap 15 is located at point G. X is the horizontal distance between point G and point E, and Y is the vertical distance between point G and point E. The distance FE is the distance between the center of the pulley 7 and the axis of the rotary brush 3. This distance determines the tension of the drive belt 9.

Referring to FIG. 2C, it can be seen by noting the orientation of the sides a, b, c, d that end cap 15 has been rotated 180°. The center G of the end cap 15 remains unchanged. However, the axis of the rotary brush is now at point E'. The distance FE' equals FE and, therefore, the tension of the belt 9 is the same in either of the positions shown in FIGS. 2B or 2C. However, in comparing the position of rotary brush 3 in FIGS. 2B and 2C, it can be seen that, in the position in FIG. 2C, the rotary brush is lower by a distance 2Y. The distances X and Y are shown in FIG. 2A.

Thus, the present invention provides for a tool in which the rotary brush may be positioned in either a raised position as shown in FIG. 2B or a lowered position as shown in FIG. 2C, merely by rotating the end cap member 15 180°. However, when the brush is changed from the lowered to the raised position or vice-versa, the tension of the belt 9 remains constant because the distance FE=FE'.

The above-described relationship is obtained by fixing the relationship between x and y wherein $X=Y \tan \theta$, wherein $\theta$ is the angle between the center line H—H of the end cap 15 and the line K—K, which passes through the center G of the end cap 15 and the point E or E', which is the intersection of the axis of the rotary brush with the end cap 15. The position of the end cap 15 may be changed by removing the belt 9 from the pulley 7 and then lowering the end cap 15 within the retaining member 19. The end cap 15 is rotated 180° and then is reinserted in the receiving member 19, following which the belt 9 is then again placed on pulley 7.

The capability of positioning the rotary brush in two positions doubles the useful life of the rotary brush. With the brush in the upper position as illustrated in FIG. 2B, the bristles of the brush will extend a predetermined distance into the carpet and the rotation of the brush will result in wear. After a predetermined amount of wear occurs, the brush is rotated 180° to the second position and the bristles now extend a greater distance from the housing. However, because of the wear which has already occurred, the distance which the bristles extend now corresponds to the first predetermined distance and the brush can be used until the predetermined amount of wear occurs again.

Figure 4:
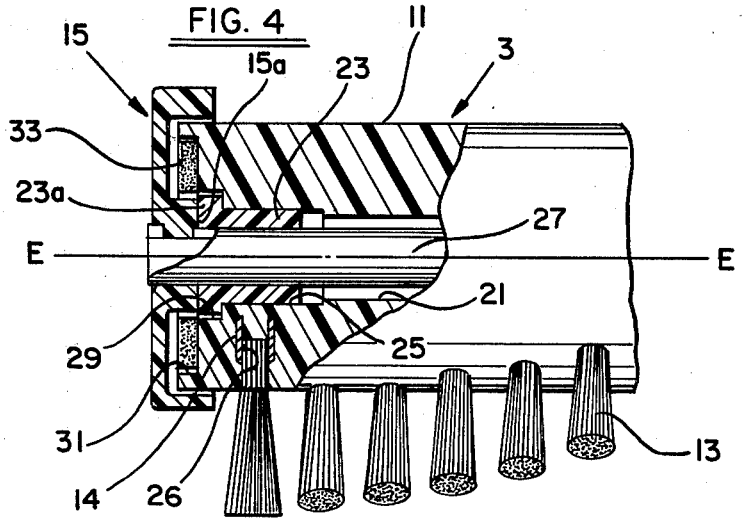
FIG. 4 is a partial sectional view of a rotary brush and supporting structure of the present invention.

FIG. 4 illustrates the mounting structure for the rotary brush 11. The brush 11 has a first bore 21 through the center thereof which is aligned with the axis E of the rotary brush. A bearing 23 is fitted into a second bore 25 and is held therein so that the bearing and rotary brush 3 rotate about axle 27, which is positioned in the bore 21 and which is aligned with the axis E. The bearing 23 has a flange portion 23*a* which is positioned within a third bore 29 which extends partially into the dowel 11. End cap 15 engages the end portion of axle 27 and contacts the flange 23*a* which functions as a bearing surface with surface 15*a* of the end cap 15. A fourth bore 31 is formed in dowel 11 and is coaxial with bores 21, 25 and 29. A washer 33 of a resilient material, such as felt, may be placed in the fourth bore to seal the bearing structure from dust.

As can be seen in FIG. 4, because of the structure of the bearing 23 and bores 21, 25 and 27, the bristles 13 are positioned relatively close to the edge 11*a* of the dowel 11. This is significant because brush 3 is a small diameter brush. The diameter of dowel 11 is less than 22.3 mm. If bore 25 were deeper, as is required in prior art devices, then the radial distance between the periphery of the bore and the bristles would be substantially smaller, and the bristles could not be held in place using a staple. The use of a small diameter brush is important for reducing the overall size of the tool, thereby making it easier to use.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description, and all changes which come within the meaning and range of equivalency of the claims are, therefore, to be embraced therein.

What is claimed:

1. A rotary brush for use in a vacuum cleaner tool, said apparatus comprising:

(a) a dowel having a diameter of less than 22.3 millimeter;

(b) a first axial bore extending along the axis of said dowel;

(c) an axle positioned in said first axial bore and extending therefrom;

(d) a second axial bore in said dowel;

(e) a third axial bore in said dowel;

(f) bearing means fixed to the periphery of said second axial bore for rotatably mounting said dowel on said axle, wherein said bearing means includes a flange extending radially from said one end thereof in said third bore; and (g) end cap means mounted on the portion of said axle which extends from said first bore.

2. In a vacuum cleaner tool having a housing, a rotary brush extending therefrom, and drive means for rotating said brush, said drive means including a motor and a drive belt coupling said motor to said brush, wherein said brush has an axle through the center thereof about which said brush rotates, the improvement comprising: end cap means fixed to the axle of said brush wherein the axis of said axle is positioned a predetermined distance X and a predetermined distance Y from the center of said mounting portion of said end cap means, wherein X and Y are perpendicular to each other and wherein $X = Y \tan \theta$, where $\theta$ is the angle between the center line of said end cap means and the line passing through the center of said end cap means and the point defined by X and Y, wherein said brush has a center bore extending along the axis thereof, said axle being positioned in said center bore and extending therefrom, a second bore coaxial with said center bore, said second bore extending only partially into said brush, and a third bore coaxial with said center bore and extending only partially into said brush, and wherein bearing means are mounted in said brush in said second bore thereof for supporting said brush on said axle, said bearing means includes a flange at one end thereof, said flange being positioned in said third bore and engaging the inner face of said third bore.

3. An improvement as set forth in claim 2, wherein said end cap means is fixed to the portion of said axle which extends from said bearing means.

4. A vacuum cleaner tool comprising:

(a) a housing;

(b) a motor means positioned in said housing, said motor means having a driving pulley connected to the output shaft thereof;

(c) a rotatable brush means mounted in said housing and having a portion thereof extending from said housing for contacting a surface to be vacuumed, said brush means having an axle extending therefrom along the axis thereof;

(d) a drive belt for coupling said pulley to said brush means; and (e) end cap means mounted on the axle of said brush means for mounting said brush means in said housing in two positions, wherein said brush extends a smaller distance from said housing in the first of said two positions, and wherein the center of said end cap means is positioned with respect to the axis of said brush means such that when said end cap means is rotated 180°, said brush means is shifted between said two positions and the distance from the center of said pulley to the axis of said brush means remains substantially constant, wherein said brush means has a center bore extending along the axis thereof, said axle being positioned in said center bore and extending therefrom, second and third bores coaxial with said center bore, said second and third bores extending only partially into said brush means, and wherein bearing means are mounted in said brush means in said second bore thereof for supporting said brush means on said axle, said brush means including a flange at one end thereof, said flange being positioned in said third bore and engaging the inner face of said third bore.

5. In a cleaning tool having a housing provided with a protruding brush rotating on an axle and further having a belt connecting the brush to a driving pulley, the improvement in adjustable mounting means for the brush, thereby providing for a height adjustment of the brush with respect to the tool housing, which comprises: the mounting means having a center, the axle having first and second respective positions which are each eccentric with respect to the center of the mounting means, means for shifting the axle circumferentially by substantially 180 degrees from its first eccentric position into its second eccentric position, and vice versa, and wherein the driving pulley has an axis disposed on a line which passes substantially through the center of the mounting means and which is substantially perpendicular to a line connecting the first and second eccentric positions of the axle, whereby the distance between the pulley axis and the brush axle remains substantially constant as the axle is shifted from its first eccentric position into its second eccentric position, and vice-versa, thereby assuring that the tension on the belt remains substantially constant regardless of an adjustment in brush height.

* * * * *